US009372489B2

(12) United States Patent
Kobayashi et al.

(10) Patent No.: US 9,372,489 B2
(45) Date of Patent: Jun. 21, 2016

(54) VOLTAGE REGULATOR HAVING A TEMPERATURE SENSITIVE LEAKAGE CURRENT SINK CIRCUIT

(71) Applicant: Seiko Instruments Inc., Chiba-shi, Chiba (JP)

(72) Inventors: Yuji Kobayashi, Chiba (JP); Teruo Suzuki, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/517,153

(22) Filed: Oct. 17, 2014

(65) Prior Publication Data

US 2015/0108953 A1 Apr. 23, 2015

(30) Foreign Application Priority Data

Oct. 22, 2013 (JP) ..... 2013-219530

(51) Int. Cl.

*G05F 1/56* (2006.01)
*G05F 1/567* (2006.01)
*G05F 3/24* (2006.01)

(52) U.S. Cl.

CPC *G05F 1/56* (2013.01); *G05F 1/567* (2013.01); *G05F 3/245* (2013.01)

(58) Field of Classification Search

CPC ..... G05F 1/56; G05F 1/567; G05F 1/462; G05F 3/222; G05F 3/225; G05F 3/242; G05F 3/245; G05F 1/575; G05F 1/573; H02M 2001/327; H02M 1/32; H02M 3/33507

See application file for complete search history.

(56) References Cited

U.S. PATENT DOCUMENTS

| | | | | |
|---|---|---|---|---|
| 8,710,812 | B1 * | 4/2014 | Edwards | G05F 1/56 323/281 |
| 2004/0130378 | A1 * | 7/2004 | Kihara | H03F 3/347 327/362 |
| 2008/0203983 | A1 * | 8/2008 | Lo Lacono | G05F 1/565 323/266 |
| 2008/0297234 | A1 * | 12/2008 | Moholt | G05F 3/262 327/541 |
| 2010/0201331 | A1 * | 8/2010 | Imura | G05F 1/56 323/234 |
| 2013/0169250 | A1 * | 7/2013 | Bouwman | G05F 3/16 323/272 |
| 2014/0063668 | A1 * | 3/2014 | Nagata | G05F 1/56 361/57 |

FOREIGN PATENT DOCUMENTS

JP 2012-226421 A 11/2012

* cited by examiner

*Primary Examiner* — Nguyen Tran
*Assistant Examiner* — Gustavo Rosario Benitez
(74) *Attorney, Agent, or Firm* — Brinks Gilson & Lione

(57) ABSTRACT

Provided is a voltage regulator including a leakage current sink circuit capable of suppressing an influence of a leakage current of an output transistor at high temperature, and reducing power consumption of the voltage regulator at normal temperature. The voltage regulator includes: a reference voltage circuit configured to output a reference voltage; an output transistor configured to output an output voltage; a voltage divider circuit configured to divide the output voltage to output a feedback voltage; an error amplifier circuit configured to amplify a difference between the reference voltage and the feedback voltage, and output the amplified difference to control a gate of the output transistor; and a leakage current sink circuit connected to an output terminal and configured to be prevented from operating at normal temperature, and suppress an influence of a leakage current from the output transistor only at high temperature.

4 Claims, 6 Drawing Sheets

VOLTAGE REGULATOR HAVING A TEMPERATURE SENSITIVE LEAKAGE CURRENT SINK CIRCUIT

RELATED APPLICATIONS

This application claims priority under 35 U.S.C. §119 to Japanese Patent Application No. 2013-219530 filed on Oct. 22, 2013, the entire content of which is hereby incorporated by reference.

BACKGROUND OF THE INVENTION

1. Field of the Invention

The present invention relates to a voltage regulator including a leakage current sink circuit capable of suppressing a leakage current of an output transistor at high temperature, and reducing power consumption of the voltage regulator at normal temperature.

2. Description of the Related Art

FIG. 6 illustrates a related-art voltage regulator configured to suppress a leakage current of an output transistor. The related-art voltage regulator includes a reference voltage circuit 103, a differential amplifier circuit 104, an output transistor 105, a voltage divider circuit 106, and a leakage current sink circuit 107.

The differential amplifier circuit 104 compares a reference voltage VREF output from the reference voltage circuit 103 and a feedback voltage VFB output from the voltage divider circuit 106, and controls a gate voltage of the output transistor 105 so that an output voltage VOUT of an output terminal 102 is kept at a predetermined value.

The output voltage VOUT is independent of a power supply voltage and is constant as expressed by Expression (1).

$$\mathrm{VOUT}=(RS+RF)/RS\times\mathrm{VREF} \quad (1)$$

where RS represents a resistance value of a resistor 122, and RF represents a resistance value of a resistor 121.

In a state in which no load is connected to the output terminal 102 or a light load is connected thereto, the differential amplifier circuit 104 controls a gate-source voltage of the output transistor 105 so that the output transistor 105 enters a substantially off state, to thereby cause only a current necessary for keeping an output of the voltage divider circuit 106 to flow, or cause a current obtained by adding to the current a current amount for the light load to flow. In this case, a current Ifb that flows through the voltage divider circuit 106 is ideally expressed by Expression (2).

$$Ifb=\mathrm{VREF}/RS \quad (2)$$

The output voltage VOUT is expressed by Expression (3) with use of the current Ifb flowing through the voltage divider circuit 106.

$$\mathrm{VOUT}=(RS+RF)\times Ifb \quad (3)$$

However, at high temperature, a leakage current Ileak of the output transistor 105 flows. The leakage current Ileak exponentially increases along with an increase in temperature to be non-negligible. Thus, in a state in which no load is connected to the output terminal 102 or a light load is connected thereto, the leakage current Ileak ultimately flows into the voltage divider circuit 106.

Hence, Expression (3) is transformed into Expression (4) at high temperature.

$$\mathrm{VOUT}=(RS+RF)\times(Ifb+I\mathrm{leak}) \quad (4)$$

Therefore, the output voltage VOUT is increased due to an influence of the leakage current Ileak, and the voltage regulator cannot operate normally. To deal with this, the leakage current sink circuit 107 including a depletion type NMOS transistor 111 and an NMOS transistor 112 is used to reduce the influence of the leakage current (for example, see Japanese Patent Application Laid-open No. 2012-226421).

However, the related-art voltage regulator has a problem in that current flows through the leakage current sink circuit 107 from the output terminal 102 even at normal temperature, and hence the power consumption cannot be reduced.

SUMMARY OF THE INVENTION

The present invention has been made in view of the above-mentioned problem, and provides a voltage regulator including a leakage current sink circuit capable of suppressing an influence of a leakage current of an output transistor at high temperature, and reducing power consumption of the voltage regulator at normal temperature.

In order to solve the related-art problem, a voltage regulator according to one embodiment of the present invention has the following configuration.

The voltage regulator includes: a reference voltage circuit configured to output a reference voltage; an output transistor configured to output an output voltage; a voltage divider circuit configured to divide the output voltage to output a feedback voltage; an error amplifier circuit configured to amplify a difference between the reference voltage and the feedback voltage, and output the amplified difference to control a gate of the output transistor; and a leakage current sink circuit connected to an output terminal of the voltage regulator. The leakage current sink circuit includes: temperature detection means; and a transistor configured to cause a leakage current to flow, which is controlled by a signal output from the temperature detection means. The leakage current sink circuit is configured to be prevented from operating at normal temperature, and suppress an influence of the leakage current from the output transistor on the output terminal only at high temperature.

The voltage regulator including the leakage current sink circuit according to one embodiment of the present invention can be prevented from operating to reduce the power consumption at normal temperature, and can sink the leakage current from the output transistor to suppress the influence of the leakage current at high temperature. Further, the leakage current sink circuit includes as elements thereof the similar transistors, namely, NMOS transistors and depletion type NMOS transistors so that the process fluctuations can be suppressed.

DETAILED DESCRIPTION OF THE PREFERRED EMBODIMENTS

In the following, embodiments of the present invention are described with reference to the drawings.

[First Embodiment]

Figure 1:
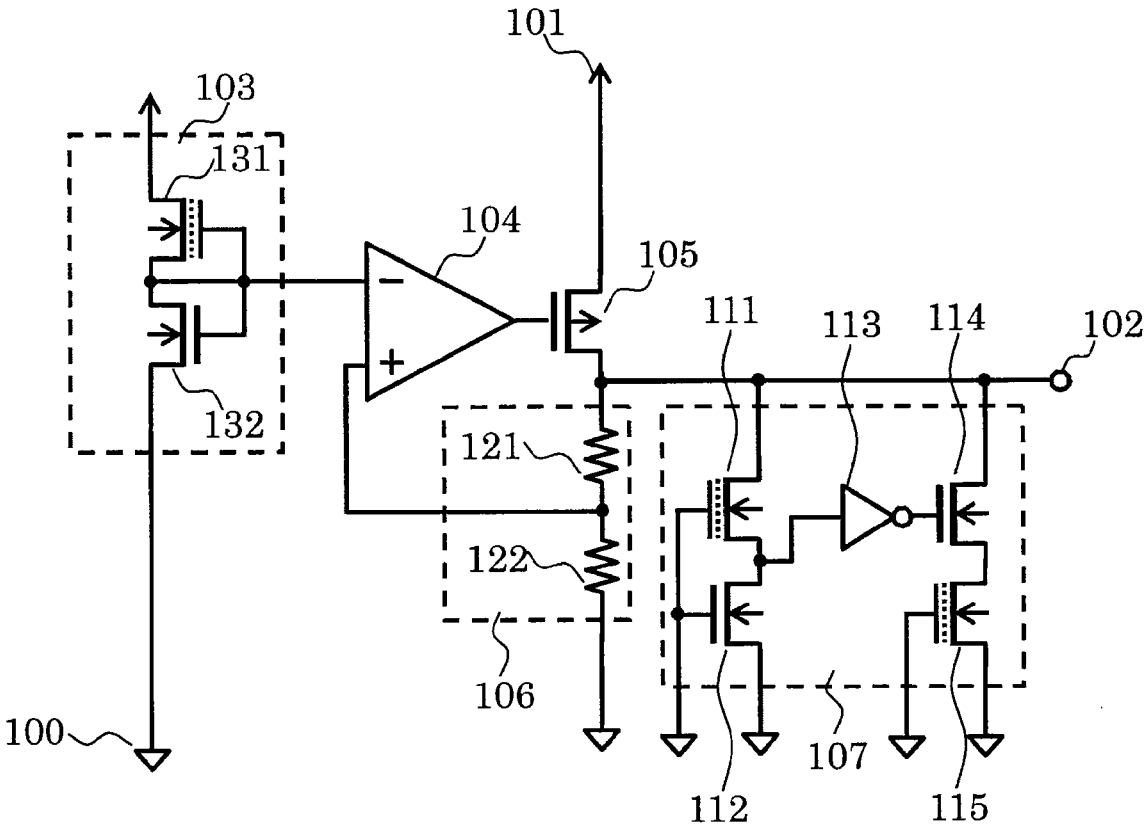
FIG. 1 is a circuit diagram illustrating a voltage regulator according to a first embodiment of the present invention.

FIG. 1 is a circuit diagram illustrating a voltage regulator according to a first embodiment of the present invention. The voltage regulator of the first embodiment includes a reference voltage circuit 103, a differential amplifier circuit 104, an output transistor 105, a voltage divider circuit 106, a leakage current sink circuit 107, a ground terminal 100, a power supply terminal 101, and an output terminal 102. The reference voltage circuit 103 includes a depletion type NMOS transistor 131 and an NMOS transistor 132. The voltage divider circuit 106 includes resistors 121 and 122. The leakage current sink circuit 107 includes depletion type NMOS transistors 111 and 115, NMOS transistors 112 and 114, and an inverter 113.

The depletion type NMOS transistor 131 has a gate and a source both connected to a gate and a drain of the NMOS transistor 132 and an inverting input terminal of the differential amplifier circuit 104, and a drain connected to the power supply terminal 101. The NMOS transistor 132 has a source connected to the ground terminal 100. The differential amplifier circuit 104 has an output terminal connected to a gate of the output transistor 105, and a non-inverting input terminal connected to a node between one terminal of the resistor 121 and one terminal of the resistor 122. The output transistor 105 has a source connected to the power supply terminal 101, and a drain connected to the output terminal 102 and the other terminal of the resistor 121. The other terminal of the resistor 122 is connected to the ground terminal 100. The depletion type NMOS transistor 111 has a gate connected to the ground terminal 100, a drain connected to the output terminal 102, and a source connected to a drain of the NMOS transistor 112 and an input terminal of the inverter 113. The NMOS transistor 112 has a gate and a source both connected to the ground terminal 100. The NMOS transistor 114 has a gate connected to an output of the inverter 113, a drain connected to the output terminal 102, and a source connected to a drain of the depletion type NMOS transistor 115. The depletion type NMOS transistor 115 has a gate and a source both connected to the ground terminal 100.

Next, the operations of the voltage regulator of the first embodiment are described.

At normal temperature, the NMOS transistor 112 allows no current to flow between the output terminal 102 and the ground terminal 100, and the depletion type NMOS transistor 111 starts in a state in which a channel is formed. Thus, High is input to the input terminal of the inverter 113. Then, the inverter 113 outputs Low to turn off the NMOS transistor 114. In this way, the leakage current sink circuit 107 causes no consumption current to flow at normal temperature.

At high temperature, the depletion type NMOS transistor 111 causes a junction leakage current and causes an off leakage current of the NMOS transistor 112 to flow, and hence a voltage of the input terminal of the inverter 113 drops to input Low. Then, the inverter 113 outputs High to turn on the NMOS transistor 114 so that a leakage current from the output transistor 105 is sunk by a current amount that can flow through the depletion type NMOS transistor 115. In this way, the leakage current of the output transistor 105 can be sunk to suppress the influence of the leakage current only at high temperature.

Note that, a threshold of the depletion type NMOS transistor and a threshold of the NMOS transistor are determined by implanting the same ions having different concentrations into the transistors by the same device. Thus, even if the thresholds fluctuate due to variation of the device, the directions of the fluctuation are the same, and hence the process fluctuations can be suppressed.

Note that, the reference voltage circuit 103 may have any configuration without limitation as long as the operations of the present invention are achieved.

Further, although not illustrated, at least one depletion type NMOS transistor having a gate and a drain connected to each other may be connected in series between the drain of the NMOS transistor 112.

Further, a power supply terminal of the inverter 113 may be connected to the power supply terminal 101 or the output terminal 102.

As described above, according to the voltage regulator of the first embodiment, the leakage current sink circuit 107 can be prevented from operating to reduce the power consumption at normal temperature, and the leakage current sink circuit 107 can operate to sink the leakage current of the output transistor 105 so that the influence of the leakage current can be suppressed at high temperature.

Further, the leakage current sink circuit 107 includes as elements thereof the similar transistors, namely, the depletion type NMOS transistors and the NMOS transistors so that the process fluctuations can be suppressed.

[Second Embodiment]

Figure 2:
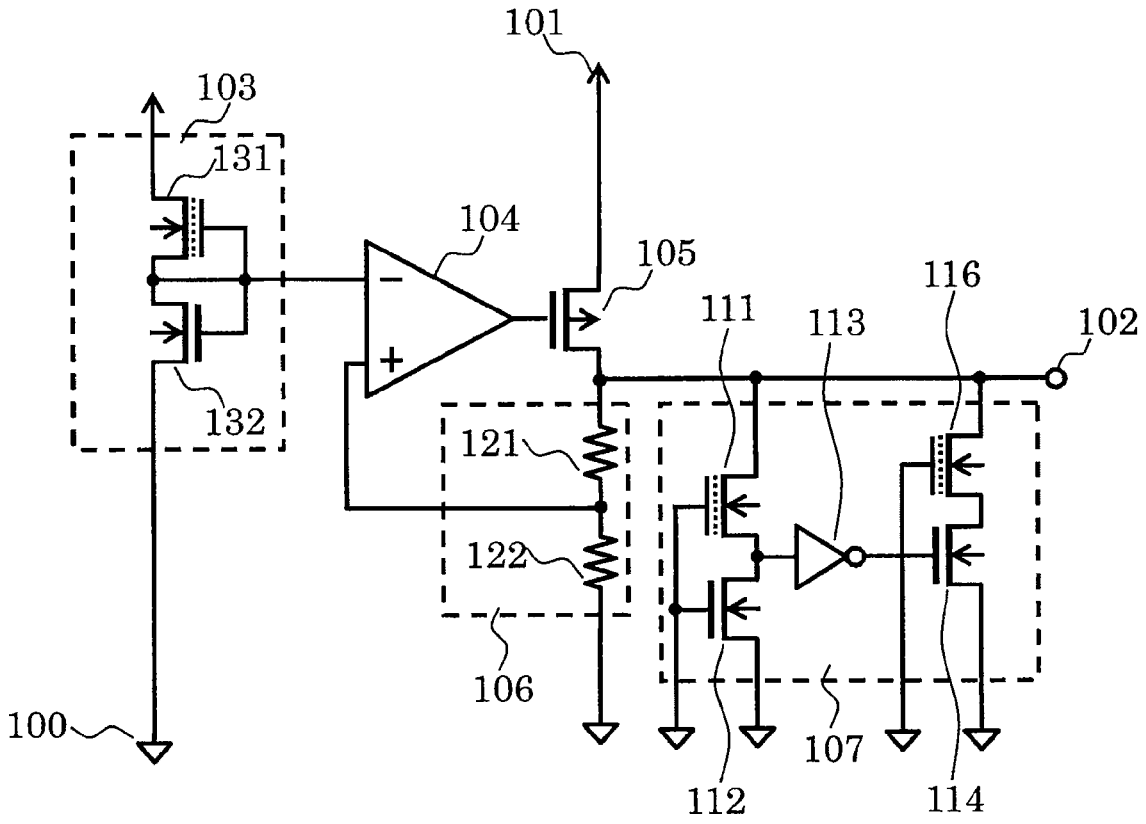
FIG. 2 is a circuit diagram illustrating a voltage regulator according to a second embodiment of the present invention.

FIG. 2 is a circuit diagram illustrating a voltage regulator according to a second embodiment of the present invention. FIG. 2 differs from FIG. 1 in that the drain of the NMOS transistor 114 is connected to a source of a depletion type NMOS transistor 116, and the depletion type NMOS transistor 116 has a gate connected to the ground terminal 100, and a drain connected to the output terminal 102. Also with this configuration, the voltage regulator can operate as in the first embodiment.

Note that, although not illustrated, even when the gate and the source of the depletion type NMOS transistor 111 are connected to each other, the voltage regulator can operate similarly. Further, the reference voltage circuit 103 may have any configuration without limitation as long as the operations of the present invention are achieved.

As described above, according to the voltage regulator of the second embodiment, the leakage current sink circuit 107 can be prevented from operating to reduce the power consumption at normal temperature, and the leakage current sink circuit 107 can operate to sink the leakage current so that the influence of the leakage current can be suppressed at high temperature. Further, the leakage current sink circuit 107 includes as elements thereof the similar transistors, namely, the depletion type NMOS transistors and the NMOS transistors so that the process fluctuations can be suppressed.

[Third Embodiment]

Figure 3:
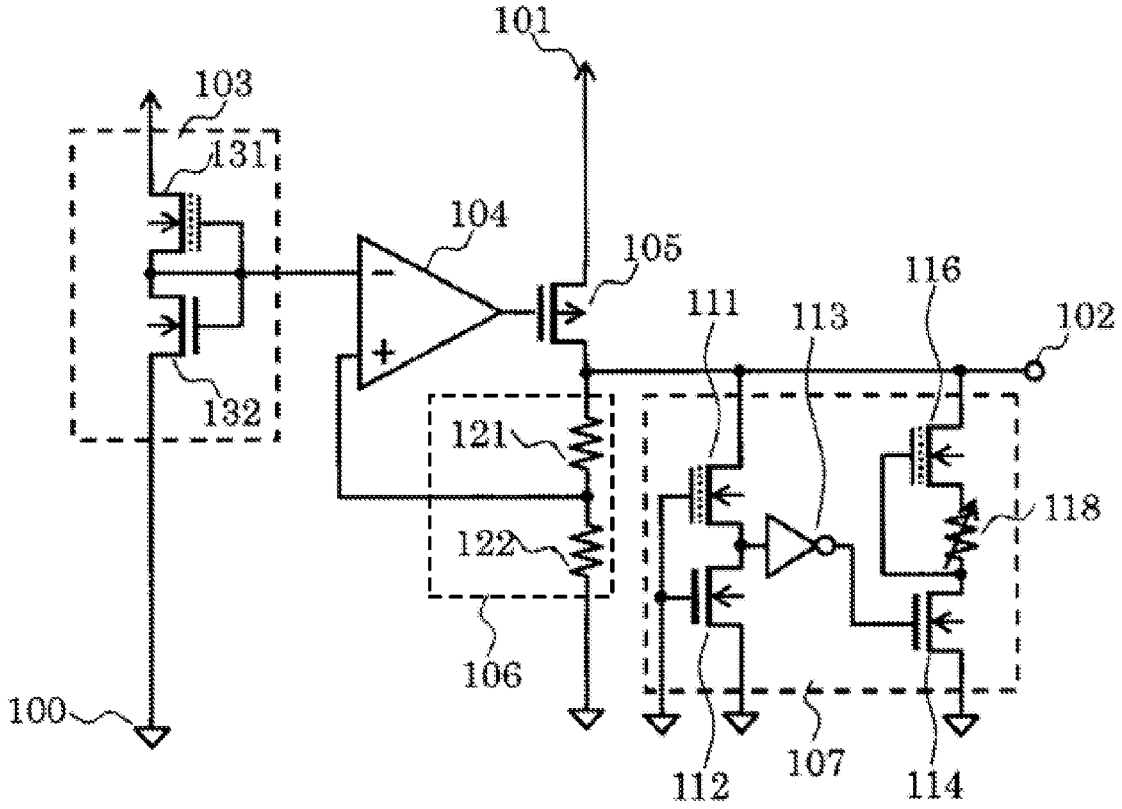
FIG. 3 is a circuit diagram illustrating a voltage regulator according to a third embodiment of the present invention.

FIG. 3 is a circuit diagram illustrating a voltage regulator according to a third embodiment of the present invention. FIG. 3 differs from FIG. 2 in that a resistor 118 is connected between the source of the depletion type NMOS transistor 116 and the drain of the NMOS transistor 114, and the gate of the depletion type NMOS transistor 116 is connected to the drain of the NMOS transistor 114.

Next, the operations of the voltage regulator of the third embodiment are described.

At normal temperature, the NMOS transistor 112 allows no current to flow between the output terminal 102 and the ground terminal 100, and the depletion type NMOS transistor 111 starts in a state in which a channel is formed. Thus, High is input to the input terminal of the inverter 113. Then, the inverter 113 outputs Low to turn off the NMOS transistor 114. In this way, the leakage current sink circuit 107 causes no consumption current to flow at normal temperature.

At high temperature, the depletion type NMOS transistor 111 causes the junction leakage current and causes the off leakage current of the NMOS transistor 112 to flow, and hence the voltage of the input terminal of the inverter 113 drops to input Low. Then, the inverter 113 outputs High to turn on the NMOS transistor 114 so that the leakage current from the output transistor 105 is sunk by a current amount that can flow through the depletion type NMOS transistor 116. In this way, the leakage current can be sunk to suppress the influence of the leakage current only at high temperature. In addition, by trimming the resistor 118 to adjust a current amount to be sunk, the influence of the leakage current can be more accurately suppressed.

Note that, instead of the resistor 118, a depletion type NMOS transistor, which has a gate and a drain connected to each other and operates in a non-saturation region, may be connected in series.

Further, the reference voltage circuit 103 may have any configuration without limitation as long as the operations of the present invention are achieved.

As described above, according to the voltage regulator of the third embodiment, the leakage current sink circuit 107 can be prevented from operating to reduce the power consumption at normal temperature, and the leakage current sink circuit 107 can operate to sink the leakage current so that the influence of the leakage current can be suppressed at high temperature. Further, the influence of the leakage current can be more accurately suppressed by trimming the resistor 118.

[Fourth Embodiment]

Figure 4:
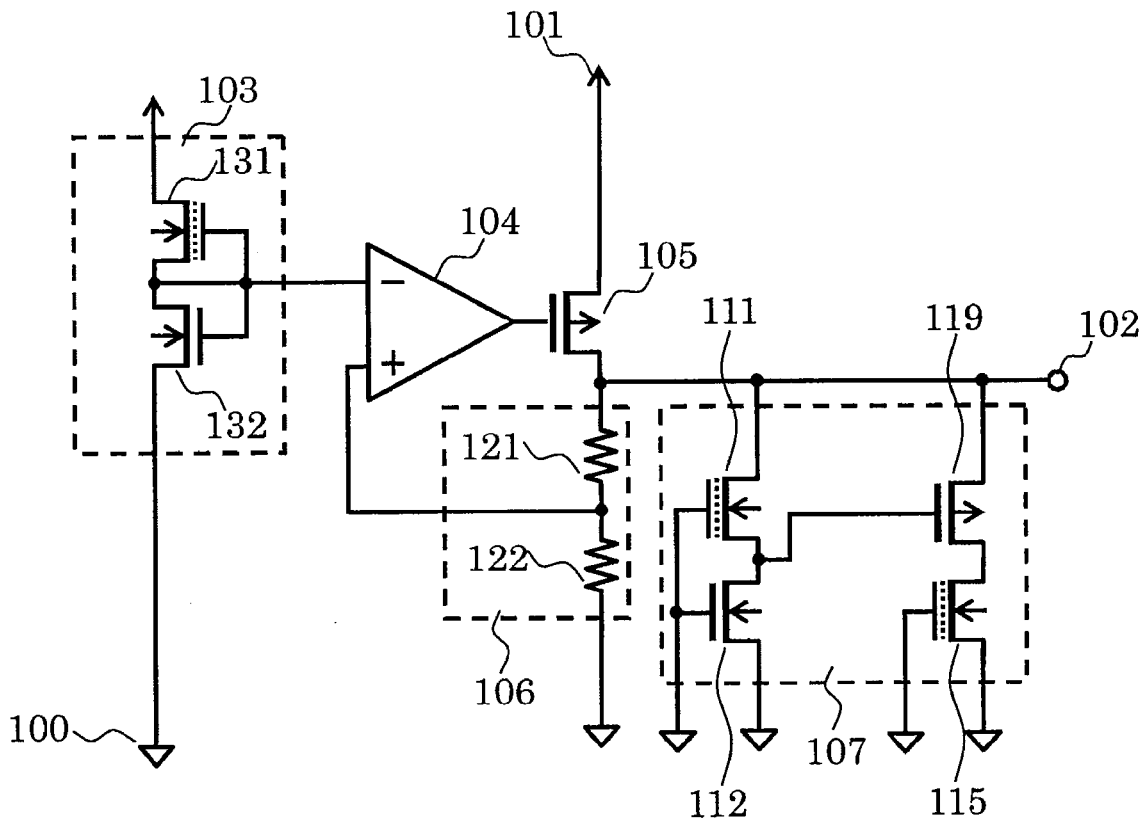
FIG. 4 is a circuit diagram illustrating a voltage regulator according to a fourth embodiment of the present invention.

FIG. 4 is a circuit diagram illustrating a voltage regulator according to a fourth embodiment of the present invention. FIG. 4 differs from FIG. 1 in that the NMOS transistor 114 is changed to a PMOS transistor 119, and the inverter 113 is eliminated. A gate of the PMOS transistor 119 is connected to the drain of the NMOS transistor 112.

Next, the operations of the voltage regulator of the fourth embodiment are described.

At normal temperature, the NMOS transistor 112 allows no current to flow between the output terminal 102 and the ground terminal 100, and the depletion type NMOS transistor 111 starts in a state in which a channel is formed. Thus, High is input to the gate of the PMOS transistor 119 to turn off the PMOS transistor 119. In this way, the leakage current sink circuit 107 causes no consumption current to flow at normal temperature.

At high temperature, the depletion type NMOS transistor 111 causes the junction leakage current and causes the off leakage current of the NMOS transistor 112 to flow, and hence a voltage of the gate of the PMOS transistor 119 drops to turn on the PMOS transistor 119. Then, the leakage current from the output transistor 105 is sunk by a current amount that can flow through the depletion type NMOS transistor 115. In this way, the leakage current can be sunk to suppress the influence of the leakage current only at high temperature. Because the gate of the PMOS transistor 119 inputs a signal directly from the NMOS transistor 112, the off leakage current can be increased along with an increase in temperature to increase a gate-source voltage of the PMOS transistor 119 so that a current to be sunk can flow even in the non-saturation state. Hence, even when the leakage current sink circuit 107 is in a lower temperature state, the leakage current can be sunk bit by bit. Further, the number of the elements can be reduced to reduce an area of the leakage current sink circuit 107.

Note that, the reference voltage circuit 103 may have any configuration without limitation as long as the operations of the present invention are achieved.

As described above, according to the voltage regulator of the fourth embodiment, the leakage current sink circuit 107 can be prevented from operating to reduce the power consumption at normal temperature, and the leakage current sink circuit 107 can operate to sink the leakage current so that the influence of the leakage current can be suppressed at high temperature.

Figure 5:
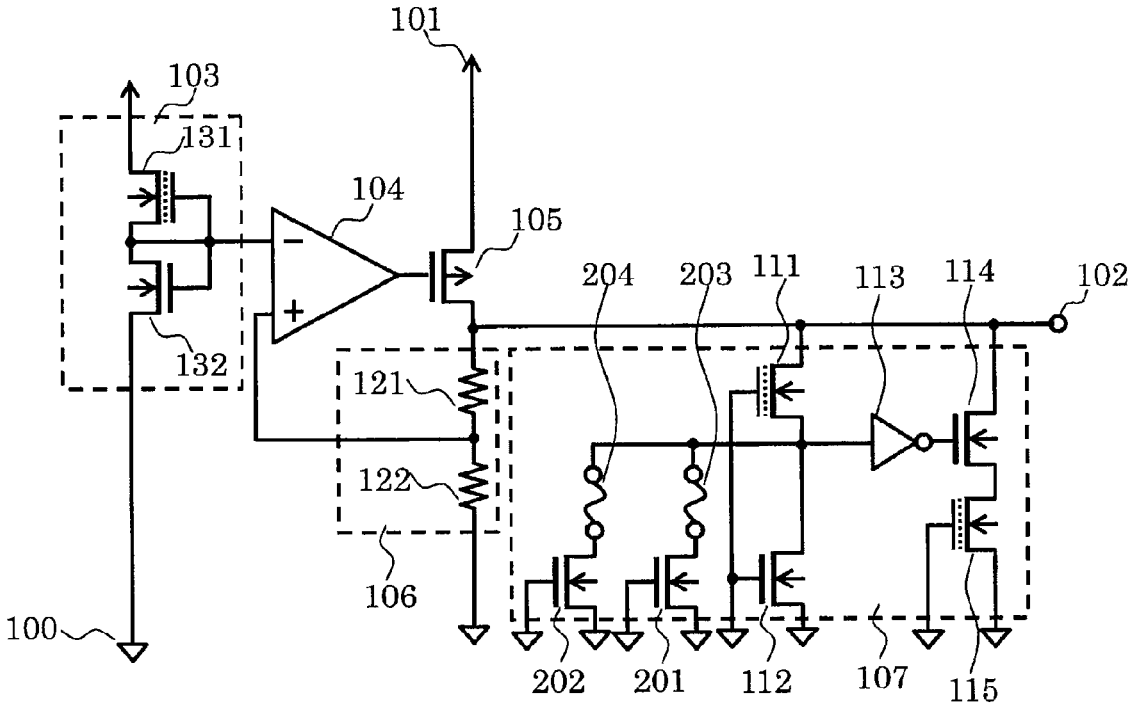
FIG. 5 is a circuit diagram illustrating a voltage regulator according to a fifth embodiment of the present invention.
Figure 6:
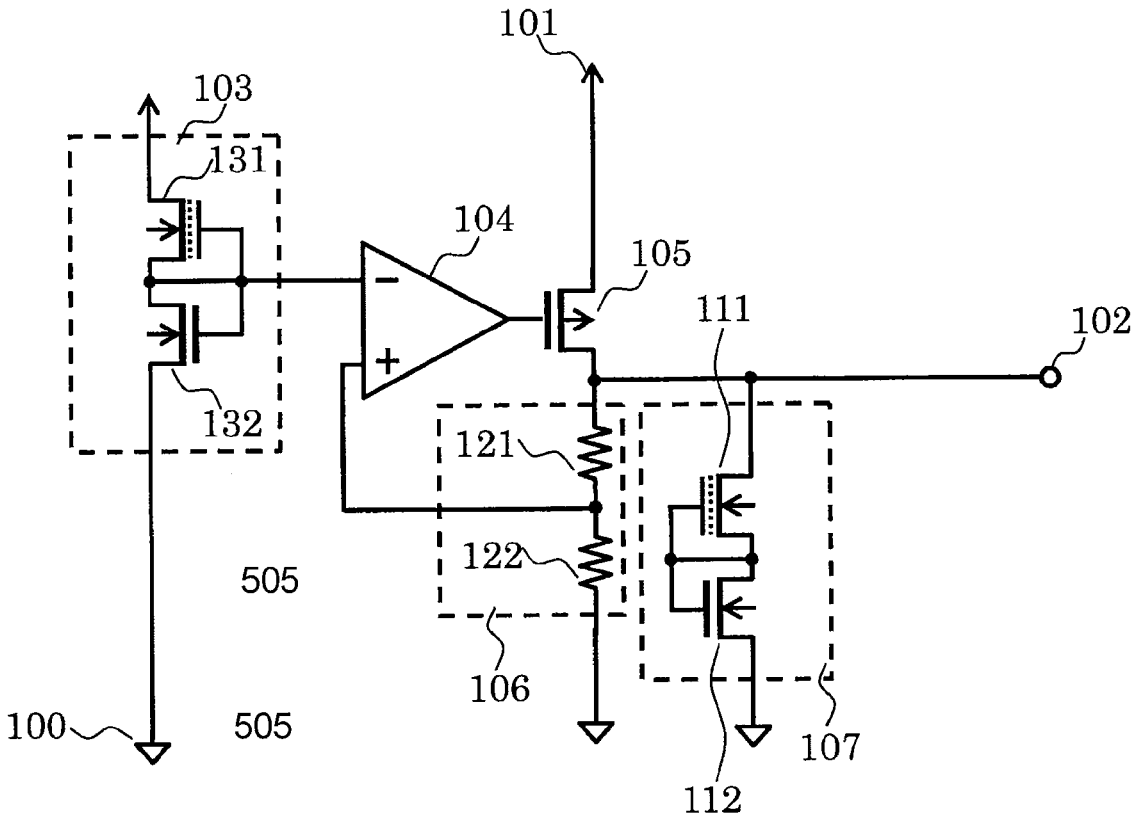
FIG. 6 PRIOR ART
FIG. 6 is a circuit diagram illustrating a related-art voltage regulator.

FIG. 5 is a circuit diagram illustrating another example of the voltage regulator according to the present invention. FIG. 5 differs from FIG. 1 in that NMOS transistors 201 and 202 and fuses 203 and 204 are added.

The NMOS transistor 201 has a gate and a source connected to the ground terminal 100, and a drain connected to one terminal of the fuse 203. The other terminal of the fuse 203 is connected to the input terminal of the inverter 113. The NMOS transistor 202 has a gate and a source connected to the ground terminal 100, and a drain connected to one terminal of the fuse 204. The other terminal of the fuse 204 is connected to the input terminal of the inverter 113. Other connections are the same as those of FIG. 1.

In the voltage regulator illustrated in FIG. 5, by trimming the fuses 203 and 204, a leakage current that flows when the leakage current sink circuit 107 and the output transistor 105 have the same temperature can have an optimal value, and a temperature at which the leakage current from the output transistor 105 is sunk can thus be adjusted.

Note that, the three NMOS transistors 201, 202, and 112 are connected in parallel, but the number of the transistors is not limited to three and four or more transistors may be connected in parallel. Further, even when the configuration illustrated in FIG. 5 is applied to the circuits illustrated in FIG. 2 to FIG. 4, the same effects can be obtained.

As described above, according to the voltage regulator of the present invention, the leakage current sink circuit 107 can be prevented from operating to reduce the power consumption at normal temperature, and the leakage current sink circuit 107 can operate to sink the leakage current from the output transistor 105 so that the influence of the leakage current can be suppressed at high temperature.

What is claimed is:

1. A voltage regulator comprising:

a reference voltage circuit configured to output a reference voltage;

an output transistor configured to output an output voltage;

a voltage divider circuit configured to divide the output voltage and to output a feedback voltage;

an error amplifier circuit configured to amplify a difference between the reference voltage and the feedback voltage, and output the amplified difference to control a gate of the output transistor; and a leakage current sink circuit connected to an output terminal of the voltage regulator, the leakage current sink circuit comprising:

a temperature circuit comprising:

a first enhancement transistor including a gate and a source both connected to a ground terminal; and a second depletion transistor including a gate connected to the ground terminal, a drain connected to the output terminal, and a source connected to a drain of the first transistor; and a transistor circuit configured to cause a leakage current to flow, that is controlled by a signal output from the temperature detection circuit, wherein the transistor circuit comprises:

a third transistor configured to be turned on and off in accordance with a voltage of the source of the second transistor; and a fourth transistor connected to the third transistor, the fourth transistor configured to cause the leakage current to flow from the output terminal, the leakage current sink circuit configured to be prevented from operating at normal temperature, and suppress an influence of the leakage current from the output transistor on the output terminal only at high temperature.

2. A voltage regulator according to claim 1, wherein the fourth transistor includes a drain connected to the output terminal, and a gate and a source between which a resistor is connected, the gate being connected to a drain of the third transistor.

3. A voltage regulator according to claim 1, wherein a transistor size of the first enhancement transistor is adjustable by trimming.

4. A voltage regulator according to claim 2, wherein a transistor size of the first enhancement transistor is adjustable by trimming.

* * * * *